US008412090B2

(12) United States Patent
Jang et al.

(10) Patent No.: US 8,412,090 B2
(45) **Date of Patent: *Apr. 2, 2013**

(54) IMAGE FORMING APPARATUS

(75) Inventors: Jae Young Jang, Suwon-si (KR); Chang Kyung Ko, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/227,880

(22) Filed: Sep. 8, 2011

(65) Prior Publication Data

US 2012/0026527 A1 Feb. 2, 2012

Related U.S. Application Data

(63) Continuation of application No. 12/119,579, filed on May 13, 2008, now Pat. No. 8,036,590.

(30) Foreign Application Priority Data

Aug. 17, 2007 (KR) ..... 10-2007-0082733

(51) Int. Cl.
*G03G 15/00* (2006.01)
*B65H 15/00* (2006.01)

(52) U.S. Cl. ..... 399/405; 399/361; 399/381; 271/184; 271/185; 271/186

(58) Field of Classification Search ..... 399/361, 399/363, 364, 381, 397–411
See application file for complete search history.

(56) References Cited

U.S. PATENT DOCUMENTS

| | | | | |
|---|---|---|---|---|
| 5,931,458 | A * | 8/1999 | Morimoto | 271/186 |
| 5,950,050 | A * | 9/1999 | Shirasaki et al. | 399/124 |
| 7,493,062 | B2 * | 2/2009 | Igarashi | 399/111 |
| 8,036,590 | B2 * | 10/2011 | Jang et al. | 399/405 |
| 2004/0196512 | A1 | 10/2004 | Chen et al. | |
| 2006/0056875 | A1 * | 3/2006 | Karasawa et al. | 399/107 |
| 2006/0198677 | A1 * | 9/2006 | Baek et al. | 399/405 |
| 2007/0242998 | A1 * | 10/2007 | Ishio et al. | 399/405 |

FOREIGN PATENT DOCUMENTS

| | | | |
|---|---|---|---|
| JP | 06250463 | A * | 9/1994 |
| JP | 06250464 | A * | 9/1994 |
| JP | 09012200 | A * | 1/1997 |
| JP | 2001109211 | A * | 4/2001 |

* cited by examiner

*Primary Examiner* — Matthew G Marini
*Assistant Examiner* — Nguyen Q Ha
(74) *Attorney, Agent, or Firm* — Stanzione & Kim, LLP

(57) ABSTRACT

Disclosed is an image forming apparatus. The image forming apparatus includes a housing having a discharge port, a plurality of photosensitive bodies mounted in the housing, a transfer unit to transfer visible images formed on the plurality of photosensitive bodies onto a printing medium, a fusing unit to fuse transferred visible images to the printing medium, and a reverse unit to reverse a moving direction of the printing medium, after the printing medium has passed through the fusing unit. As the moving direction of the printed printing medium is reversed by the reverse unit, the printing medium may be discharged while a printed surface of the printing medium is directed downward, allowing a user to easily draw out the printing medium.

20 Claims, 6 Drawing Sheets

IMAGE FORMING APPARATUS

CROSS-REFERENCE TO RELATED APPLICATIONS

This application is a continuation application of Ser. No. 12/119,579 filed May 13, 2008 now U.S. Pat. No. 8,036,590 in the United States Patent and Trademark Office, which claims priority under 35 U.S.C. §119(a) from Korean Patent Application No. 2007-0082733, filed on Aug. 17, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus having an improved printing medium feeding path.

2. Description of the Related Art

An image forming apparatus is an apparatus that prints a black and white image or a color image on a printing medium, e.g., paper, according to an image signal, for example, a laser printer, an ink-jet printer, a copying machine, a multi-function printer, a fax machine, etc. An image forming apparatus is classified as an electrophotographic type in which a beam is scanned to a photosensitive body to form an electrostatic latent image, a developer is supplied to the electrostatic latent image to form a visible image, and the visible image is transferred onto a printing medium, or an ink-jet type in which a liquid type ink is ejected onto a surface of a printing medium according to an image signal.

An image forming apparatus generally includes a printing medium feeding unit to supply a printing medium, a printing unit to print letters or pictures on the printing medium supplied from the printing medium feeding unit, and a printing medium discharge unit to discharge the printed printing medium. In an electrophotographic image forming apparatus, the printing unit includes a photosensitive body, an exposure unit to irradiate light to the photosensitive body, a developing unit to supply a developer to the electrostatic latent image formed on the photosensitive body to form a visible image, a transfer unit to transfer the visible image formed on the photosensitive body onto the printing medium, and a fusing unit to fuse the visible image to the printing medium by applying heat and pressure to the printing medium. In an ink-jet image forming apparatus, the printing unit includes a print head to eject an ink onto the surface of the printing medium according to an image signal.

In the image forming apparatus as structured above, a shape of a feeding path of a printing medium is determined dependent on structures of the printing medium feeding unit, the printing unit and the printing medium discharge unit and arrangement of components of the respective units. The printing medium feeding path of the image forming apparatus is generally shaped in an L-type, a C-type, an S-type, or the like. The image forming apparatus can be classified as a front-in-front-out (FIFO) type or a front-in-side-out (FISO) type according to supplying and discharging directions of the printing medium.

The structures and arrangement of the respective devices are important factors in determining a shape of the printing medium feeding path and the printing medium supplying and discharging directions. However, the convenience in use related to replenishment of the printing medium and the drawing out of the printed printing medium also should be considered.

As an example of the conventional image forming apparatus, U.S. Patent Publication No. US2004/0196512A1 (published on Oct. 7, 2004) discloses a multi-function printer having a C-type printing medium feeding path. The disclosed conventional image forming apparatus includes an ink-jet type printing module provided in a housing, and a scanning module provided at an upper portion of the housing. A printing medium feeding cassette, in which the printing medium is loaded, is mounted to a front lower portion of the housing. A printing medium discharge tray, to which the printed printing medium is discharged, is mounted above the printing medium feeding cassette.

The above-structured image forming apparatus is a FIFO type image forming apparatus, in which the printing medium is picked up rearward from the printing medium feeding cassette, is printed while being fed forward, and is discharged to the printing medium discharge tray mounted to the front portion of the housing. Accordingly, the above conventional image forming apparatus allows the replenishment and the drawing out of the printing medium to be easily achieved.

However, the above conventional image forming apparatus is configured such that the printed printing medium is discharged to the printing medium discharge tray while a printed surface of the printing medium is directed upward. Therefore, when plural sheets of printing media are printed, the printed pages are arranged in a reverse order, which gives a user inconvenience of arranging the printed pages in a correct order.

SUMMARY OF THE INVENTION

The present general inventive concept provides an image forming apparatus having an improved printing medium feeding path, by which a printing medium is discharged while a printed surface of the printing medium is directed downward and the printing medium can be easily drawn out.

The present general inventive concept also provides an image forming apparatus whose overall size is compact.

Additional aspects and/or utilities of the present general inventive concept will be set forth in part in the description which follows and, in part, will be obvious from the description, or may be learned by practice of the general inventive concept.

In accordance with one aspect of the invention, an image forming apparatus includes a housing having a discharge port, a plurality of photosensitive bodies, a plurality of developing units to supply developer to the plurality of photosensitive bodies, respectively, so as to form visible images, a feeding unit to feed a printing medium having a first end and a second end to the plurality of developing units such that the first end of the printing medium is at the head of the printing medium, a transfer unit to transfer the visible images formed on the plurality of photosensitive bodies onto a printing medium, a fusing unit to fuse transferred visible images to the printing medium, and a reverse unit to reverse a moving direction of the printing medium, after the printing medium has passed through the fusing unit, such that the second end of the printing medium precedes the first end of the printing medium, wherein the printing medium is discharged out of the discharge port in a state wherein the second end of the printing medium is at the head of the printing medium.

The reverse unit may be provided with an opening to enable the first end of the printing medium to pass through before the moving direction of the printing medium is reversed by the reverse unit.

The reverse unit may be provided with an inclined portion disposed adjacent to the opening to turn the first end of the printing medium in a downward direction before the moving direction of the printing medium is reversed by the reverse unit. The inclined portion may include guide ribs to make the printing medium move smoothly downward.

The housing may include an opening to allow the first end of the printing medium to be moved out of the housing before the moving direction of the printing medium is reversed by the reverse unit. The image forming apparatus may further include a cover pivotally attached to the housing, wherein a receiving space is formed between the housing and the cover to receive the first end of the printing medium moving out of the housing through the opening.

The cover may include a plurality of guide ribs to downwardly guide the first end of the printing medium received in the receiving space. The reverse unit may include a printing medium guide to guide the second end of the printing medium toward the discharge port when the printing medium is fed in the reverse moving direction.

The reverse unit may include a reverse roller to reverse the moving direction of the printing medium so as to feed the printing medium toward the discharge port. The discharge port may be formed to face a front portion of the housing, the transfer unit may be mounted in the housing at a position adjacent to a front surface of the housing, and the opening may be formed in a rear surface of the housing.

The feeding unit may include a feeding cassette to load printing medium and a pickup device to pick up the printing medium located in the feeding cassette.

In accordance with another aspect of the invention, an image forming apparatus includes a housing having a first side, a second side, and a discharge port facing the first side of the housing, a plurality of photosensitive bodies, a plurality of developing units to supply developer to the plurality of photosensitive bodies, respectively, so as to form visible images, a transfer unit mounted in the housing at a position adjacent to the first side of the housing, the transfer unit serving to transfer the visible images formed on the plurality of photosensitive bodies onto a printing medium, a fusing unit to fuse transferred visible images to the printing medium, at least one feeding roller to feed the printing medium, after the printing medium has passed through the fusing unit, in a first direction toward the second side of the housing, an opening formed in a region of the second side of the housing to allow a leading edge of the printing medium fed by the at least one feeding roller to be moved through the opening formed in the region of the second side of the housing, and a reverse roller to reverse a moving direction of the printing medium, fed in the first direction by the feeding roller, so as to allow the printing medium to move in a second direction toward the first side of the housing.

The image forming apparatus may further include an inclined portion provided adjacent to the opening to turn the leading edge of the printing medium in a downward direction before the moving direction of the printing medium is reversed by the reverse roller.

The inclined portion may include guide ribs to make the printing medium move smoothly downward. The image forming apparatus may further include a printing medium guide to guide the printing medium, whose moving direction has been reversed by the reverse roller, to the discharge port.

The image forming apparatus may further include a receiving space communicating with the opening to receive the leading edge of the printing medium fed by the at least one feeding roller, and a cover to open or close the receiving space. The cover may include a plurality of guide ribs arranged in the receiving space to downwardly guide the leading edge of the printing medium entering the receiving space.

In accordance with a further aspect of the invention, an image forming apparatus includes a housing formed with a discharge port, a plurality of photosensitive bodies, a plurality of developing units to supply developer to the plurality of photosensitive bodies, respectively, so as to form a visible image, a transfer unit to transfer the visible image formed on at least one of the plurality of photosensitive bodies onto a printing medium, a feeding unit to receive the printing medium, the feeding unit serving to feed the printing medium to the transfer unit, a fusing unit to fuse the visible image, which has been transferred to the printing medium by the transfer unit, to the printing medium, a printing path vertically extending between the feeding unit and the fusing unit, a first discharge path along which the printing medium having passed through the fusing unit is moved, a second discharge path having one end connected to the first discharge path and the other end connected to the discharge port, and a reverse unit to reverse a moving direction of the printing medium passing through the first discharge path and to guide the reversed printing medium to the second discharge path.

The housing may include an opening communicating with the first discharge path,

The image forming apparatus may further include a receiving space communicating with the first discharge path through the opening to receive a leading edge of the printing medium before the printing medium is reversed by the reverse unit, and a cover to cover the receiving space so as to downwardly guide the leading edge of the printing medium entering the receiving space.

The second discharge path may obliquely extend upward from the first discharge path to the discharge port. The first discharge path may extend in a substantially horizontal direction.

The reverse unit may include a reverse roller to reverse the moving direction of the printing medium moving toward the opening, and a printing medium guide to guide the reversed printing medium toward the discharge port.

The discharge port may be formed to face a front portion of the housing, the transfer unit may be mounted in the housing at a position adjacent to a front surface of the housing, and the opening may be formed in a rear surface of the housing.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
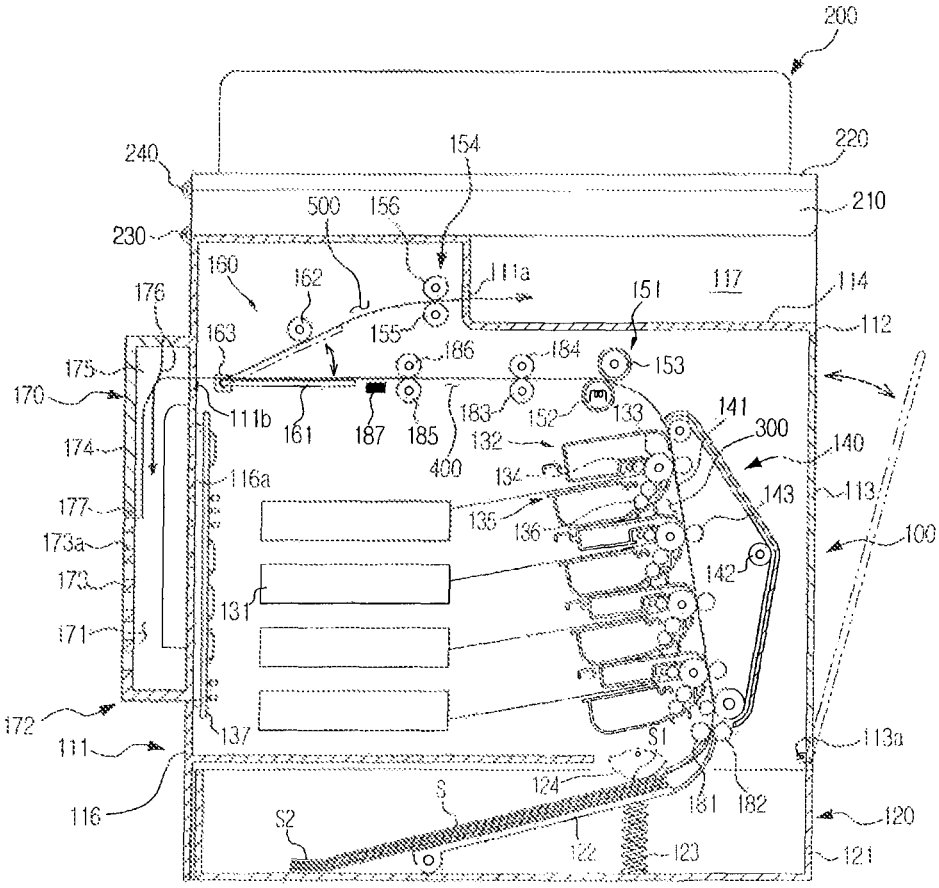
FIG. 1 is a side-sectional view schematically illustrating an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

As illustrated in FIG. 1, an image forming apparatus according to the present invention includes a printing module 100 to print an image on a printing medium, and a scanning module 200 provided above the printing module 100 to scan a document. The scanning module 200 is hingedly coupled to an upper portion of the printing module 100 by a hinge device 230.

The printing module 100 includes a housing 111, a feeding unit 120, exposure units 131, photosensitive body units 132, developing units 135, a transfer unit 140, a circuit board 137, a fusing unit 151, a reverse unit 160, a discharge unit 154, and a space forming unit 170. The housing 111 forms an exterior appearance, and the feeding unit 120 is mounted below the housing 111. The exposure units 131, the photosensitive body units 132 and the developing units 135 are mounted to a substantially inner center portion of the housing 111. The transfer unit 140 is mounted to an inner front portion of the housing 111, and the circuit board 137 is mounted to an inner rear portion of the housing 111. The fusing unit 151, the reverse unit 160 and the discharge unit 154 are mounted to an inner upper portion of the housing 111. The space forming unit 170 is mounted to a rear of the housing 111. Feeding rollers 181, 183 and 185 and idle rollers 182, 184 and 186 to feed the printing medium, and a sensor 187 to detect a position of the fed printing medium are mounted in a printing medium feeding path in the housing 111. The printing medium feeding path includes a printing path 300 vertically extending between the feeding unit 120 and the fusing unit 151, a first discharge path 400 along which the printing medium having passed through the fusing unit 151 is moved, and a second discharge path 500 having one end connected to the first discharge path 400 and the other end connected to a discharge port 111*a*. The first discharge path 400 extends in a substantially horizontal direction, and the second discharge path 500 obliquely extends upward from the first discharge path 400 to the discharge port 111*a*. Once the printing medium is fed from the feeding unit 120, the printing medium is first moved along the printing path 300 and then, enters the first discharge path 400 after passing through the fusing unit 151. The reverse unit 160 reverses a moving direction of the printing medium having passed through the first discharge path 400. Then, the printing medium is fed to the second discharge path 500 and is discharged out of the housing 111 by the discharge unit 154.

Figure 2:
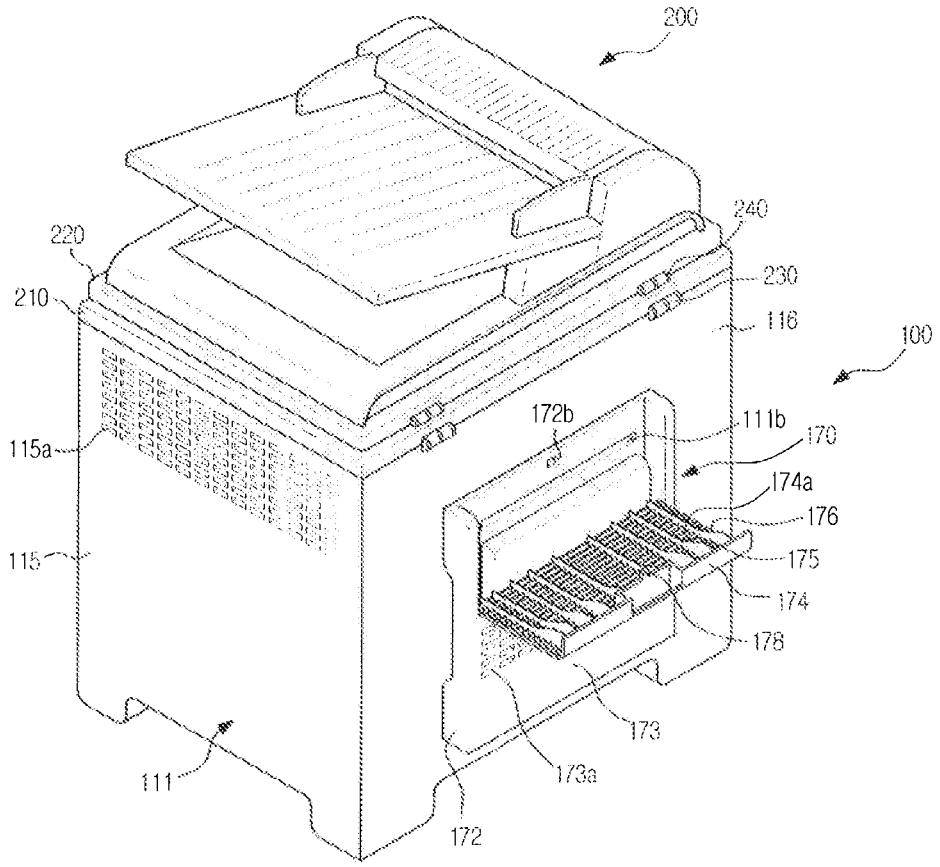
FIG. 2 is a perspective view schematically illustrating the image forming apparatus in accordance with an embodiment of the present general inventive concept.

A front cover 113 is mounted to the front portion of the housing 111 to open and close an opened front surface 112 of the housing 111. The front cover 113 can pivot on a hinge member 113*a* provided at a lower end portion of the front cover 113. A discharge tray 114 is provided at an upper portion of the housing 111, onto which the printed printing medium is discharged and loaded. The discharge port 111*a* is provided at a rear portion of the discharge tray 114, through which the printed printing medium is discharged out of the housing 111 to the discharge tray 114. As illustrated in FIGS. 1 and 2, heat radiation holes 115*a* and 116*a* are provided at both side surfaces 115 and a rear surface 116 of the housing 111 to radiate heat generated from the interior of the housing 111 to the exterior. Especially, the heat radiation holes 116*a* provided at the rear surface 116 of the housing 111 radiate rapidly heat generated from the circuit board 137 mounted to an inner rear portion of the housing 111. The rear surface 116 of the housing 111 is provided with an opening 111*b* through which the printing medium having passed through the fusing unit 151 can move to a rear exterior of the housing 111. The printing medium fed in the housing 111 can move to the space forming unit 170 provided at the rear exterior of the housing 111 through the opening 111*b*.

The feeding unit 120 includes a feeding cassette 121 to load the printing medium therein, and a pickup device 124 to pick up the printing medium loaded in the feeding cassette 121. The feeding cassette 121 is mounted below the housing 111, and can be drawn forwardly out of the housing 111. Inside the feeding cassette 121 are mounted a lifting plate 122 to load the printing medium thereon and an elastic member 123 to elastically bias the lifting plate 122 toward the pickup device 124. The printing medium S received in the feeding cassette 121 has a first end S1 and a second end S2. When the printing medium S is picked up, the printing medium S is moved toward the transfer unit 140 so that the first end S1 is at the head of the printing medium.

The exposure units 131, the photosensitive body units 132 and the developing units 135 are respectively provided in plural numbers, for example, four are illustrated in this embodiment. The exposure units 131, the photosensitive body units 132 and the developing units 135 are matched to each other one by one, to form four groups. The four groups of the exposure units 131, the photosensitive body units 132 and the developing units 135 generate visible images of respectively different colors. The visible images of four colors (e.g., yellow, magenta, cyan and black) are overlapped on the surface of the printing medium, thereby generating a color image.

Each of the exposure units 131 irradiates a beam to a photosensitive body 133 provided in the corresponding photosensitive body unit 132 according to an image signal, to form an electrostatic latent image on a surface of the photosensitive body 133. Each of the photosensitive body units 132 is further provided with a charge device 134 to charge the surface of the photosensitive body 133 with a predetermined electric potential. If an electrostatic latent image is formed on the surface of the photosensitive body 133, the developing unit 135 supplies a developer to the photosensitive body 133 to form a visible image. Each of the developing units 135 includes a developing roller 136 to store a developer and apply the developer to the surface of the photosensitive body 133.

The transfer unit 140 transfers the visible images formed on the respective photosensitive bodies 133 onto the printing medium in order. The transfer unit 140 includes a feeding belt 141 to feed the printing medium supplied from the feeding unit 120 along the photosensitive bodies 133, and four transfer rollers 143 opposing the respective photosensitive bodies 133 while interposing the feeding belt 141 therebetween. The feeding belt 141 is supported by plural belt rollers 142, and feeds the printing medium toward the fusing unit 151 via the photosensitive bodies 133 while traveling in one direction (a clockwise direction). When the printing medium passes between the transfer rollers 143 and the photosensitive bodies 133 respectively corresponding to the transfer rollers 143, the transfer rollers 143 transfer the visible images formed on the photosensitive bodies 133 onto the printing medium.

When the printing medium passes by an uppermost photosensitive body 133, a color image is formed on one surface of the printing medium by the visible images of four colors being overlapped. The feeding belt 141, the belt rollers 142 and the transfer rollers 143 are mounted in a case 144. The transfer unit 140 is removably mounted to the inner front portion of the housing 111. The transfer unit 140 can be removed from or mounted into the housing 111 through the opened front surface 112 of the housing 111. Accordingly, a user can easily remove or mount the transfer unit 140 from/into the housing 111 at the front of the housing 111.

The fusing unit 151 is mounted in a downstream side from the transfer unit 140 in the printing medium feeding path. The fusing unit 151 fuses the visible image transferred onto the printing medium to the surface of the printing medium by applying heat and pressure to the printing medium having passed through the transfer unit 140. The fusing unit 151 includes a heating roller 152 to generate heat, and a press roller 153 rotating while contacting the heating roller 152.

The reverse unit 160 is mounted in a downstream side from the fusing unit 151 in the printing medium feeding path to reverse the printing medium moving rearward via the fusing unit 151 to move forward. Once the moving direction of the printing medium is reversed by the reverse unit 160, the second end S2 of the printing medium, which has been preceded by the first end S1 until the printing medium reaches the reverse unit 160, is at the head of the printing medium. The reverse unit 160 includes a printing medium guide 161 positioned below the printing medium having passed through the fusing unit 151 to guide the fed printing medium, a reverse roller 162 to feed the printing medium toward the discharge unit 154 while rotating in one direction (the counterclockwise direction), and a lifting device 163 to lift up the printing medium guide 161 toward the reverse roller 162 so that the printing medium on the printing medium guide 161 is contacted with the reverse roller 162. The lifting device 163 pivots the printing medium guide 161 in one direction (the counterclockwise direction) on a rear end portion of the printing medium guide 161 so that a front portion of the printing medium guide 161 is contacted with the reverse roller 162.

When a rear end of the printing medium having passed through the fusing unit 151 passes by the feeding roller 185 positioned in an upstream side of the printing medium guide 161, the lifting device 163 lifts up the printing medium guide 161. If the rear end of the printing medium having passed through the fusing unit 151 passes by the sensor 187 via the feeding roller 185 in the upstream side of the printing medium guide 161, the sensor 187 senses the passing of the printing medium, and generates a sensing signal. In response to the sensing signal, the lifting device 163 pivots the printing medium guide 161. By such an operation of the reverse unit 160, the printing medium having passed through the fusing unit 151 is fed toward the discharge unit 154 while a printed surface of the printing medium is directed downward.

The discharge unit 154 is mounted between the reverse roller 162 and the discharge port 111*a*, and discharges the printing medium reversed by the reverse roller 162 to the exterior through the discharge port 111*a*. The discharge unit 154 includes a discharge roller 155, and an idle roller 156 rotating while contacting the discharge roller 155.

The space forming unit 170 is mounted to the rear of the housing 111, and forms a receiving space 171 to temporarily receive the printing medium. That is, the space forming unit 170 provides a space in which the front end of the printing medium having passed by the printing medium guide 161 can move until the rear end of the printing medium completely passes by the feeding roller 185. The space forming unit 170 includes a space forming member 172 coupled to the rear surface 116 of the housing 111 to form the receiving space 171 at the exterior of the housing 111, and a cover 174 removably coupled to the space forming member 172 so as to expose the receiving space 171 to the exterior. The opening 111*b* of the housing 111 communicates with the first discharge path 400. The receiving space 171 communicates with the opening 111*b*, and extends downward from the opening 111*b* so that the front end of the printing medium having passed through the opening 111*b* can move downward by a predetermined distance.

As illustrated in FIGS. 1 and 2, both side members of the space forming member 172 have opening portions, and a rear surface 173 of the space forming member 172 is provided with through-holes 173*a* through which air can flow between the receiving space 171 and the exterior. Accordingly, air can smoothly flow between the receiving space 171 and the exterior, and the heat radiation from the housing 111 through the heat radiation holes 116*a* can be securely achieved.

The cover 174 is coupled to an upper portion of the rear surface 173 of the space forming member 172. A hinge member 177 is provided at a lower end portion of the cover 174, and a latching member 178 is formed at an upper end portion of the cover 174. The cover 174 pivots on the hinge member 177 to open and shield a portion of the space of the space forming member 172. When the cover 174 is closed, the latching member 178 of the cover 174 is fitted into a latching recess 172*b* provided at the space forming member 172. The cover 174 is provided with through-holes 174*a* to permit air flow. Heat of the printing medium heated during the fusing process is easily radiated through the through-holes 174*a*. The cover 174 is provided with plural guide ribs 175 at an inner surface thereof to guide the printing medium downward. The guide ribs 175 extend long in an up/down direction, and are arranged at a gap therebetween. The guide ribs 175 reduce friction between the cover 174 and the printing medium to make the printing medium move smoothly downward. Each of the guide ribs 175 is provided with an inclined portion 176 at an upper portion, to reverse a moving direction of the printing medium in the downward direction. Since the inclined portion 176 is inclined downwardly and in the moving direction of the printing medium passing through the opening 111*b*, if the front end of the printing medium moving horizontally comes into contact with the inclined portion 176, the moving direction of the printing medium is reversed to the downward direction. Since the opening 111*b* is exposed to the exterior if the cover 174 is opened, when a jam of the printing medium occurs near the reverse unit 160, a user can easily remove the jammed printing medium by opening the cover 174.

As described above, since the space forming unit 170 forms the receiving space 171 at the exterior of the housing 111 to permit the front end of the printing medium having passed by the printing medium guide 161 to move, providing an additional space, permitting the movement of the printing medium having passed by the printing medium guide 161, inside the housing 111 is unnecessary. If the image forming apparatus according to the present general inventive concept is not provided with the space forming unit 170, a problem occurs such that a space permitting the movement of the front end of the printing medium having passed by the printing medium guide 161 should be provided horizontally along the inside of the housing 111 or else the printing medium is partially exposed to the exterior of the housing 111. Since the space forming unit 170 reverses the moving direction of the printing medium having passed by the printing medium guide 161 into the downward direction and the receiving space 171 extends along the downward direction, the space forming unit 170 does not have a large bulk. Accordingly, an overall size of the image forming apparatus decreases, and thus the image forming apparatus of the present general inventive concept can be manufactured compactly.

As illustrated in FIGS. 1 and 2, the scanning module 200 is mounted above the housing 111. The scanning module 200 includes a main body 210 in which electronic components including an image sensor (not illustrated) are mounted, and an upper cover 220 to cover a top surface of the main body 210. The upper cover 220 is coupled to the main body 210 by a hinge device 240, and pivots on the hinge device 240 to open and shield a top surface of the main body 210.

A drawing space 117 is formed between the main body 210 of the scanning module 200 and the discharge tray 114 on the housing 111. The drawing space 117 permits a user to easily draw out the printed printing medium loaded on the discharge tray 114. Since the scanning module 200 can pivot on the hinge device 230, a user can more easily draw out the printing medium loaded on the discharge tray 114 by pivoting the scanning module 200 back.

Hereinafter, the operation of the image forming apparatus according to the present general inventive concept will be described with reference to the accompanying drawings.

If a printing signal is input, as illustrated in FIG. 1, the pickup device 124 picks up an uppermost printing medium of plural sheets of printing media loaded in the feeding cassette 121, and the feeds the printing medium to the transfer unit 140. The exposure units 131 irradiate a beam to the photosensitive bodies 133 according to an image signal, and electrostatic latent images are formed on the respective photosensitive bodies 133. The developing units 135 corresponding to the respective photosensitive bodies 133 supply a developer to the photosensitive bodies 133, and visible images of respectively different colors are formed on the photosensitive bodies 133. When the visible images are formed on the photosensitive bodies 133, the printing medium passes by the photosensitive bodies 133 in order, by the feeding belt 141. While the printing medium passes by the photosensitive bodies 133 in order, the transfer rollers 143 transfer the visible images formed on the respective photosensitive bodies 133 onto the printing medium. Accordingly, when the printing medium passes by the uppermost photosensitive body 133, a color image is formed on one surface of the printing medium by the visible images of four colors being overlapped. While passing through the fusing unit 151, the printing medium with the color image is applied with heat and pressure, and the visible images transferred onto the printing medium are fused to the surface of the printing medium. After passing through the fusing unit 151, the printing medium is fed to the opening 111*b* formed at the rear surface 116 of the housing 111 by the feeding rollers 183 and 185 mounted sequentially in the downstream side from the fusing unit 151.

Figure 3:
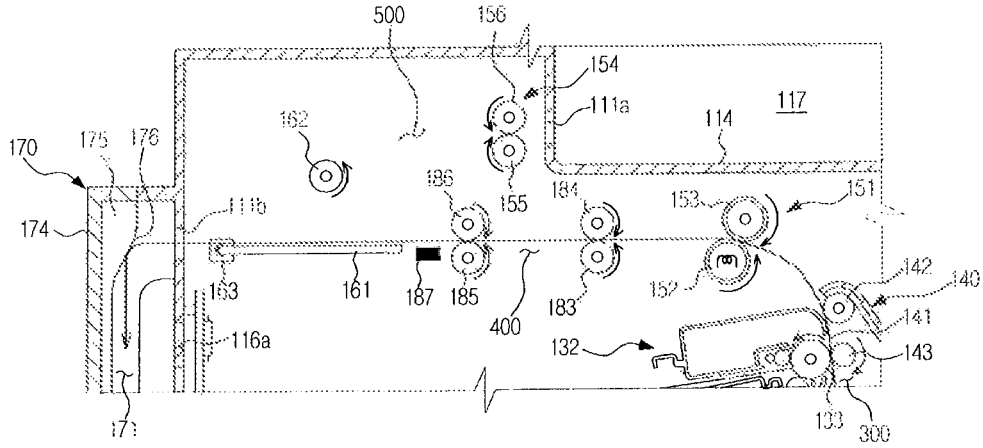
FIGS. 3 to 5 are side-sectional views illustrating a process in which a printing medium having passed through a fusing unit is discharged through a discharge port in the image forming apparatus in accordance with an embodiment of the present general inventive concept.

As illustrated in FIG. 3, the printing medium is introduced into the receiving space 171 provided at the exterior of the housing 111 (FIG. 1) through the opening 111*b* via the printing medium guide 161. The front end of the printing medium comes into contact with the inclined portions 176 of the cover 174, and the moving direction of the printing medium is reversed to the downward direction. Accordingly, the printing medium moves downward in the receiving space 171.

Figure 4:
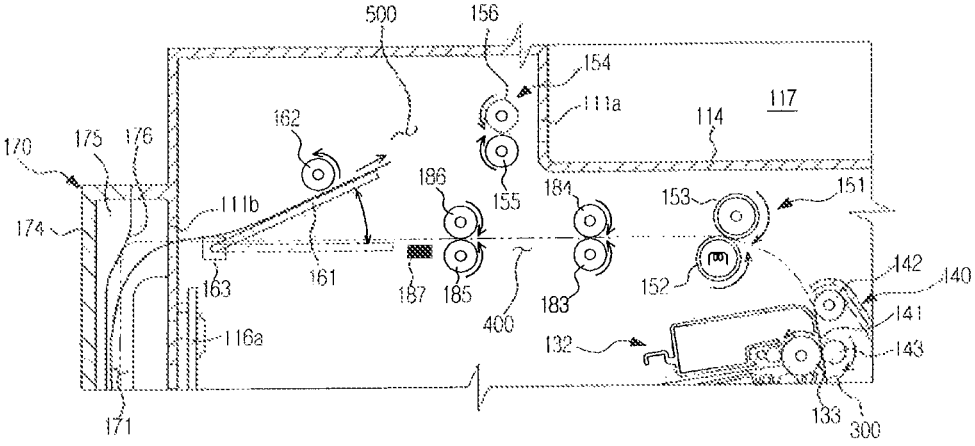

As illustrated in FIG. 4, if the printing medium moves in the receiving space 171 until the rear end of the printing medium passes by the sensor 187 mounted in the downstream side from the feeding roller 185, the lifting device 163 operates to lift up the printing medium guide 161 toward the reverse roller 162. Accordingly, the printing medium on the printing medium guide 161 comes into contact with the rotating reverse roller 162, and the printing medium is reversed toward the discharge unit 154 by the reverse roller 162.

Figure 5:
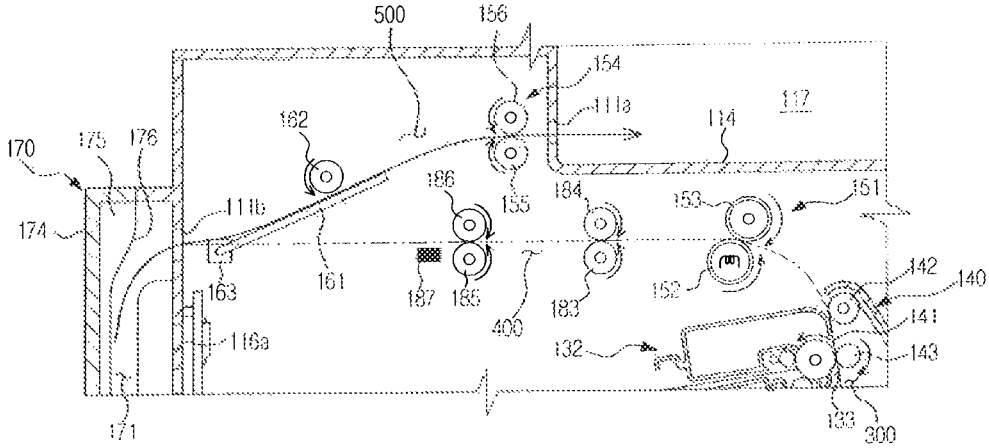

As illustrated in FIG. 5, when the printing medium is fed forward of the housing 111 (FIG. 1) by the reverse roller 162, the second end S2 of the printing medium precedes the first end S1 of the printing medium. Then, the printing medium is discharged through the discharge port 111*a* by the discharge roller 155 while the printed surface of the printing medium is directed downward, and is loaded on the discharge tray 114. Since the printed printing medium is loaded on the discharge tray 114 while the printed surface is directed downward, when plural sheets of printing media are printed, the printed pages are arranged on the discharge tray 114 in a correct order.

If a jam of the printing medium occurs near the reverse unit 160 (FIG. 1) during the printing operation, a user can easily remove the jammed printing medium by opening the cover 174.

When repairing or replacing respective components including the transfer unit 140, which are mounted to the inner front portion of the housing 111, a user can perform the repairing or replacing work at the front of the housing 111 by opening the front cover 113 provided at the front surface of the housing 111.

The image forming apparatus according to various embodiments of the present general inventive concept gives a user convenience in use, because a user can replenish or draw out the printing medium at the front of the image forming apparatus and can dismantle the components from the housing 111 at the front of the housing 111 by opening the front cover 113.

In the above description, the electrophotographic type color multi-function printer has been exemplified to illustrate the image forming apparatus according to several embodiments of the present general inventive concept. However, the present general inventive concept can also be applied to other image forming apparatuses, such as an ink-jet printer, a copying machine, a fax machine, etc.

Figure 6:
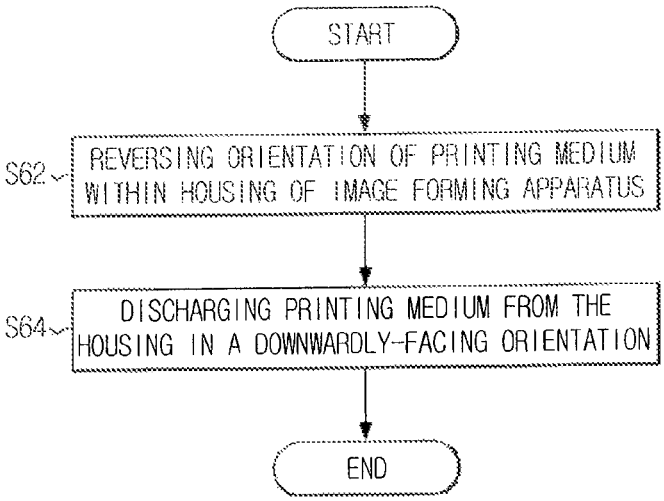
FIG. 6 is a flowchart illustrating a method of operating an image forming apparatus according to an embodiment of the present general inventive concept.

FIG. 6 is a flowchart illustrating a method of operating an image forming apparatus according to an embodiment of the present general inventive concept. Referring to FIGS. 1 and 6, in operation S62, an orientation of a printing medium is reversed within a housing 111 of the image forming apparatus. In operation S64, the printing medium is discharged from the housing 111 in a downwardly-facing orientation.

As apparent from the above description, the image forming apparatus according to several embodiments of the present general inventive concept can give a user convenience in use, because the moving direction of the printed printing medium is reversed by the reverse unit so that the printing medium can be discharged while the printed surface of the printing medium is directed downward, thereby easily drawing out the printing medium without additionally arranging the printed pages in a correct order.

Further, since the space of the space forming unit to permit the movement of the front end of the printing medium until the moving direction is reversed, is small, the overall size of the image forming apparatus can be decreased greatly.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed:

1. An image forming apparatus comprising:

a housing having a discharge port to discharge a printing medium to a discharge tray;

a scanning module located above the discharge tray;

a printing unit including a plurality of developing units vertically arranged with respect to each other and a transfer unit arranged between the plurality of developing units and an openable panel located at a front portion of the housing; and a pivotal back cover pivotally attached to a rear portion of the housing and to form a receiving space between a guiding side of the pivotal back cover and a wall disposed adjacent thereto, wherein a printing medium picked up from a paper cassette travels in a first path to move the printing medium in an upward direction through the printing unit and a rearward direction towards the rear portion of the housing, enabling the leading edge of the printing medium to move into the receiving space through an opening formed in a rear portion of the housing, and after the leading edge of the printing medium moves into the receiving space, a moving direction of the printing medium is reversed through the opening such that the printing medium is discharged out of the discharge port to the discharge tray in a state in which a printed side of the printing medium faces downward, wherein a scanned document is discharged by the scanning module in a direction towards one of right or left sides of the housing and the printing medium is discharged out of the discharge port in a direction towards the front portion of the housing.

2. The image forming apparatus according to claim 1, wherein:

the discharge tray comprises a paper holding space provided above the printing unit and below the scanning module for holding a stack of sheets of printing medium discharged from the discharge port; and both a paper cassette for storing blank papers and sheets of printing medium stacked on the discharge tray are accessible from a front side of the image forming apparatus.

3. The image forming apparatus according to claim 1, wherein the scanning module feeds a document to be scanned in a second path that is perpendicular to the first path.

4. The image forming apparatus according to claim 1, wherein the guiding side of the pivotal back cover includes a plurality of guide ribs to guide the printing medium.

5. The image forming apparatus according to claim 4, wherein the guide ribs include curved portions to enable the leading edge of the printing medium to move downwardly into the receiving space.

6. The image forming apparatus according to claim 1, wherein the transfer unit comprises a transfer belt.

7. The image forming apparatus according to claim 1, wherein the plurality of developing units further comprise a plurality of photosensitive bodies.

8. The image forming apparatus according to claim 7, further comprising:

a fusing unit to fuse transferred visible images to the printing medium.

9. The image forming apparatus according to claim 8, further comprising:

a guide plate and a lifting device to lift up the guide plate toward a reverse roller so that printing medium on the guide plate is contacted with the reverse roller, wherein, after a rear end of the printing medium passes the fusing unit, the lifting device lifts up the guide plate so that the printing medium is fed by the reverse roller towards the discharge port.

10. The image forming apparatus according to claim 1, wherein an opening is provided to enable the leading edge of the printing medium to pass through from an interior of the housing to the receiving space before the moving direction of the printing medium is reversed by a reverse unit.

11. The image forming apparatus according to claim 1, further comprising:

a reverse unit that includes a printing medium guide to guide the printing medium toward the discharge port when the moving direction of the printing medium is reversed.

12. An image forming apparatus comprising:

a housing having a front portion, a rear portion formed with an opening, and a discharge port to discharge a printing medium toward the front portion to a discharge tray;

a scanning module located above the discharge tray;

a printing unit including at least one developing unit to develop an image and a transfer unit to transfer the developed image to the printing medium, and to feed the printing medium toward the opening;

a pivotal back cover pivotally attached to a rear portion of the housing to form a receiving space between a guiding side of the pivotal back cover and a wall disposed adjacent thereto; and a guide plate to pivot between a first position to allow the printing medium to travel on a first path between the printing unit and the receiving space and a second position to direct the printing medium to a second path between the receiving space and the discharge port, wherein after the leading edge of the printing medium moves into the receiving space through the opening, the guide plate pivots to the second position and a moving direction of the printing medium is reversed through the opening such that the printing medium is discharged out of the discharge port, and wherein the receiving space has one end connected to the opening and another end being a closed end and extended from the one end to redirect the printing medium in a different direction.

13. The image forming apparatus of claim 12, further comprising:

a reverse roller to feed the printing medium towards the discharge port, the reverse roller disposed such that when the guide plate is in the second position, the printing medium on the guide plate contacts the reverse roller.

14. The image forming apparatus of claim 12, further comprising:

a lifting device to lift the guide plate from the first position to the second position.

15. The image forming apparatus of claim 14, further comprising:

a sensor disposed along the first path to detect when the trailing edge of the printing medium traveling on the first path passes the sensor, and the lifting device lifts the guide plate to the second position in response to the detection of the sensor.

16. An image forming apparatus comprising:

a housing having a front portion, a rear portion formed with an opening, and a discharge port to discharge a printing medium toward the front portion to a discharge tray;

a scanning module located above the discharge tray;

a printing unit to form an image on a first side of the printing medium and to feed the printing medium toward the opening;

a pivotal back cover attached to a rear portion of the housing to form a receiving space between a guiding side of the pivotal back cover and a wall disposed adjacent thereto; and a reverse unit to reverse a movement direction of the printing medium, wherein the printing medium moves on a first feed path from the printing unit to the receiving space such that a leading edge of the paper enters the receiving space through the opening, and after the leading edge of the paper enters the receiving space, the reverse unit reverses a moving direction of the printing medium through the opening such that the printing medium moves on a second feed path toward the discharge port and is discharged to the discharge tray with the first side facing downward, and wherein the receiving space has one end connected to the opening and another end being a closed end and extended from the one end to redirect the printing medium in a different direction.

17. The image forming apparatus of claim 16, wherein when the leading edge of the printing medium enters the receiving space, the guiding side of the pivotal back cover turns the leading edge of the printing medium downward to allow the leading edge of the printing medium to move in a downward direction into the receiving space.

18. The image forming apparatus of claim 16, wherein when the reverse unit reverses the moving direction of the printing medium, the leading edge of the printing medium is in the receiving space and a trailing edge of the printing medium is outside the receiving space.

19. The image forming apparatus of claim 16, wherein a vertical length of the receiving space is greater than a horizontal length of the receiving space.

20. The image forming apparatus of claim 16, wherein the reverse unit includes a guide plate to pivot to direct the printing medium to the second feed path.

* * * * *